US005812500A

United States Patent [19]

Webb, Jr.

[11] Patent Number: 5,812,500

[45] Date of Patent: Sep. 22, 1998

[54] SPORTS WATCH BAND

[76] Inventor: Tracy Webb, Jr., P.O. Box 22693, Knoxville, Tenn. 37933-0693

[21] Appl. No.: 340,277

[22] Filed: Nov. 15, 1994

[51] Int. Cl.[6] ..... G04B 37/16

[52] U.S. Cl. ..... 368/282; 368/10

[58] Field of Search ..... 368/281, 282, 368/286, 10; 224/164, 167, 168, 171, 173, 175, 176, 177, 178, 180

[56] References Cited

U.S. PATENT DOCUMENTS

| | | | |
|---|---|---|---|
| 2,076,221 | 4/1937 | Bradbury | 368/281 |
| 2,101,690 | 12/1937 | Sauer | 368/286 |
| 2,186,089 | 1/1940 | Baker | 224/168 |
| 2,227,131 | 12/1940 | Friedman | 368/281 |
| 2,513,782 | 4/1950 | Berkeley | 224/168 |
| 2,649,230 | 8/1953 | Thompson | 368/286 |
| 2,745,580 | 5/1956 | Ward | 368/286 |
| 4,103,808 | 8/1978 | Hallman et al. | 368/286 |
| 4,155,219 | 5/1979 | Anderson | 368/282 |
| 5,035,000 | 7/1991 | Matthais | 224/171 |

FOREIGN PATENT DOCUMENTS

| | | | |
|---|---|---|---|
| 446443 | 4/1950 | Canada | 224/168 |
| 286957 | 3/1953 | Switzerland | 224/168 |

*Primary Examiner*—Bernard Roskoski
*Attorney, Agent, or Firm*—Judy Winegar Goans

[57] ABSTRACT

A sports watch band of stretchable, washable, absorbent material is easily attached or removed from a sports watch by one or more bands inserted through the space between the watch's frame body and pin and secured to the stretchable band using a hook-and-loop or buckle closure.

3 Claims, 1 Drawing Sheet

SPORTS WATCH BAND

BACKGROUND OF THE INVENTION

1. Technical Field

This invention relates to sports equipment and more particularly to a watch band suitable for use by persons engaged in vigorous activities. This invention is a watch-band comprising a band made of elasticized, absorbent material and an easily releasable means for securing a watch to the band. The sports watch band is particularly useful for applications where the user wishes to keep track of time while engaging in some activity that may generate perspiration, such as tennis, basketball, hiking, running, or other forms of exercise.

2. Description of Related Art

Watch bands come in a variety of forms. Classically, watch bands are attached in a more or less permanent manner and open and close to permit the user to wear or remove the watch. Watch bands made in this manner may be made of a variety of materials, including leather, fabric, plastic, jewels, or metal. Each has certain advantages in particular applications. Bands with buckle-type closures generally permit the wearer to adjust the size of the band, for example. Leather and metal bands are considered durable, while jeweled "bracelet"-type bands are decorative but delicate. Plastic bands typically are inexpensive and used with less expensive watches. Fabric, leather, and some "bracelet" bands may flex but typically do not stretch over the wearer's hand. Other watch bands are available that do not require a closure but are able to flex and stretch over the wearer's hand through a clever arrangement of metal links.

In most cases, a watch band is attached to a watch by means of pins disposed between two prongs on either side of the watch. Such bands are attached more or less permanently, i.e., the band may be replaced with some difficulty but is not intended to be exchanged on a regular basis. Such attachment may be distinguished from those cases in which the watch band and watch are made integrally with each other and offer no means for attaching the watch to another band or for removing the band without damaging it. Such attachment may also be distinguished from those cases where watches and bands are designed to be exchanged readily, typically to coordinate colors or styles. At least one watch band is available with a fabric band that threads through pins on the watch, and the band is fastened and adjusted by means of a hook-and-loop closure.

None of the watch bands identified is entirely satisfactory for use with active sports. Perspiration may stain fabric or leather and cause metal or plastic bands to slide and irritate the skin. In some cases, perspiration may actually damage the watch itself.

Sweatbands may be useful to absorb perspiration, but these are typically worn around the wrist with about the same placement where it would be desirable to wear a watch.

SUMMARY

A watch band of stretchable, washable, absorbent material has a means for removably attaching a sports watch. The watch band may be easily donned and removed by the wearer and does not slide relative to the wearer's arm during vigorous activity. The means for removably attaching the watch to the band is preferably one or more hook and loop closures but may be a buckle or snap.

The present invention attempts to overcome some of the limitations of the prior art by providing a have a watch band that is suitable for use with vigorous activity. One object of the invention is to provide a watch band that is durable, comfortable to wear, and is easily donned and removed by the wearer. Another object of the invention is to provide a watch band that is absorbent and washable. A further object of the invention is to provide a watch band adapted to easy attachment and removal of a watch. These and further objects of the invention will be more fully understood from the following description of the invention.

DESCRIPTION OF THE PREFERRED EMBODIMENT

Figure 1:
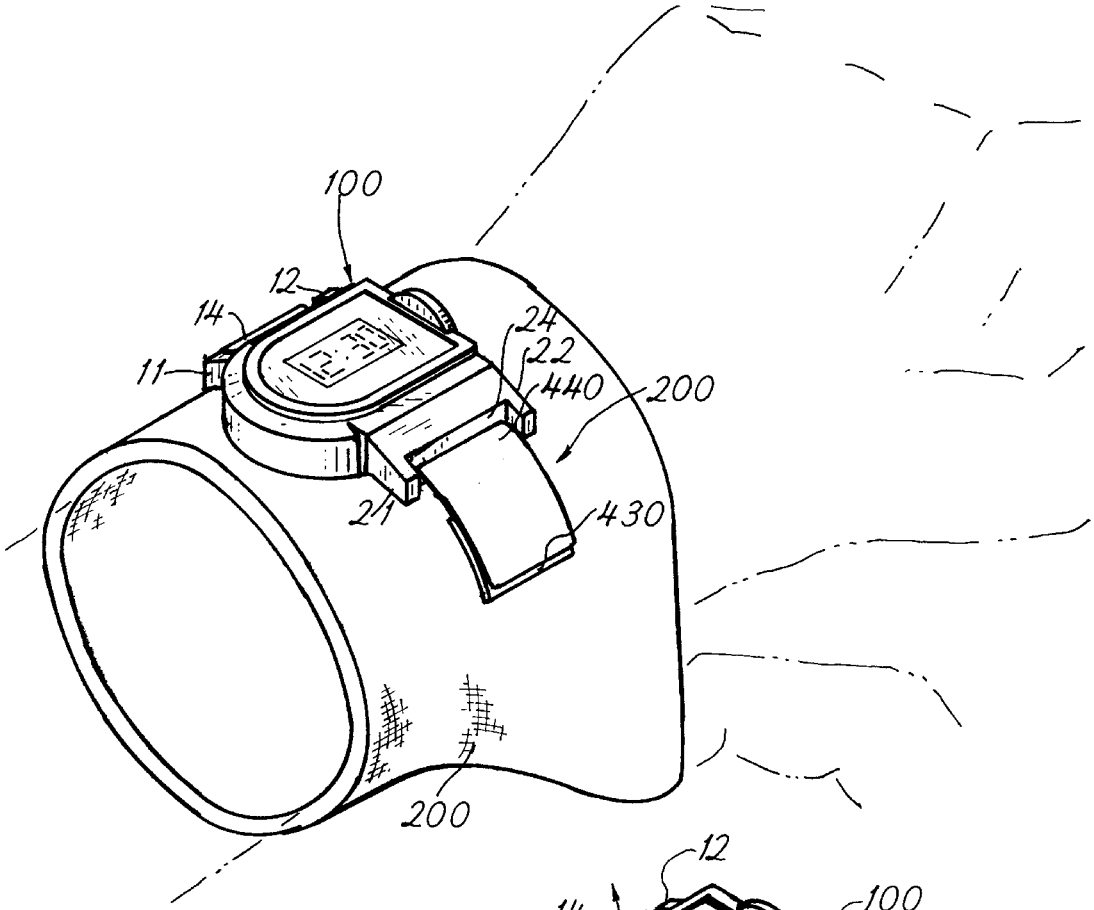
FIG. 1 is a perspective drawing illustrating the invention in use.
Figure 2:
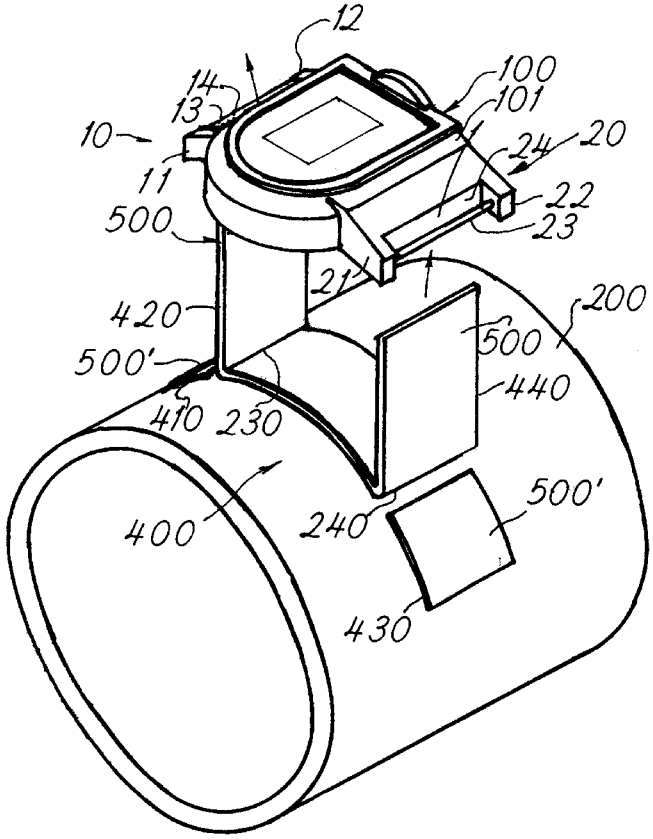
FIG. 2 is a perspective drawing showing a preferred embodiment of the invention in the open position.

Referring to FIGS. 1 and 2, a sports watch 100 is typically set into a frame with a frame body 101, prongs 11, 12 on first side 10, and prongs 21, 22 on second side 20. Disposed between the prongs 11, 12 is a pin 13, and disposed between prongs 21, 22 is a pin 23. A first narrow space 14 exists on the first side of the watch between pin 13 and the frame body 101, and a second narrow space 24 exists on the second side 20 between pin 23 the frame body 101. Spaces 14, 24 typically admit an attachment means for securing a watch band to the watch.

A first band 200 of flexible, stretchable, absorbent material is shaped in an annular ring suitable for receiving the hand of a wearer. Such an item, commonly referred to as a "sweat band," is commercially available. A sweat band is typically made of a terrycloth type material and is elasticized so that it stretches, as shown in FIG. 1. Attached to said annular band is an attachment means comprising one or more bands suitable for threading through spaces 14, 24 and fastening means suitable for receiving and securing said bands so as to attach a watch to the first band 200, or sweat band. The fastening means may be any conventional means that do not impede the passage of the second band through spaces 14, 24 and that provide adequate security for the watch when the user is engaged in vigorous activity.

Referring now to FIG. 2, a second preferred embodiment is shown wherein a first band 200 of flexible, stretchable, absorbent material is shaped in an annular ring suitable for receiving the hand of a wearer. An attachment means 400 is attached to the first band whereby the watch 100 can be removably attached to the first band 200. Attachment means 400 preferably comprises two separate portions, second band 410 and third band 420, and fourth band 430 and fifth band 440. Second band 410 and fourth band 430 are permanently secured at either end to first band 200. Third band 420 is secured to first band 200 at point 230. Fifth band 440 is likewise secured to first band 200 at point 240. As illustrated, points of attachment 230, 240 are shown as seam lines across band 200 and a single band whose ends comprise third and fifth bands 420 and 440. Second band 410, third band 420, fourth band 430, and fifth band 440 are preferably comprised of a hook and loop fastening material such that interlocking pieces 500, 500' face each other when the band is secured, i.e., second band 410 and third band 420 fasten, and fourth band 430 and fifth band 440 fasten. A sports watch 100 is secured to first band 200 by passing third 420 through space 14 on the first side 10 and securing third band 420 to second band 410 and similarly passing fifth band 440through space 24 on second side 20 and securing fifth band 440 to fourth band 430. Second band 410 and fourth band 430 are located at a convenient distance to accommodate a sports watch, typically approximately one inch (1").

In a third embodiment, illustrated in FIG. 1, attachment means 300 comprises a second band 310 and third band 320. Attached to said second band 310 is a buckle 502 suitable for receiving second band 310. Sports watch 100 is secured by passing said third band 320 through spaces 14 and 24 and securing second band 310in buckle 502.

In a fourth embodiment, attachment means 400 comprises a second band 410, third band 420, fourth band 430, and fifth band 440, as illustrated in FIG. 2. Attached to said second band 410 is a buckle 501 (not shown) suitable for receiving second band 410. Attached to said fifth band 440 is a buckle 502 suitable for receiving fourth band 430. A sports watch 100 is secured to first band 200 by passing second band 410 through space 14 on the first side 10 and securing second band 410 in buckle 501 and similarly passing fourth band 430 through space 24 on second side 20 and securing fourth band 430 in buckle 502.

I claim:

1. A watch band suitable for use in sports comprising:

an annular sweat band, a second band attached to said sweat band on a first side of its outer surface and a third band attached to said sweat band and said second band at a common point, said third band being of a size convenient to pass through narrow spaces intermediate the frame body and pin of a watch, a fourth band attached to said sweat band on a second side of its outer surface and a and fifth band attached to said sweat band and said fourth band at a common point, said fifth band being of a size convenient to pass through narrow spaces intermediate the frame body and pin of a watch, and the distance between the common point of attachment of said second and third bands and the common point of attachment of said fourth and fifth bands being approximately the width of a watch frame, and a quickly releasable fastening means for easily securing said third band to said second band and easily detaching said third band from said second band and for easily securing said fifth band to said fourth band and easily detaching said fifth band from said fourth band, where said fastening means is comprised of a hook-and-loop material, and where said fastening means does not prevent said third band and said fifth band from being passed through narrow spaces intermediate the frame body and pin of a watch.

2. A watch band as described in claim 1 wherein said second band and said third band are comprised of one side of a hook-and-loop closure material and said fourth band and said fifth band are comprised of interlocking pieces of said hook-and-loop closure material such that facing portions interlock.

3. A sports watch comprising a watch with a frame having a frame body, a pair of prongs on a first side and a pair of prongs on a second side, a first pin disposed between said pair of prongs on said first side, a second pin disposed between said pair of prongs on said second side, a first narrow space intermediate said first pin and said frame body, and a second narrow space intermediate said second pin and said frame body, a detachable, absorbent, stretchable, annular first sweat band of absorbent, washable material, attachment means comprising a narrow second band permanently attached to said first band on the first side of its outer surface and a third band attached to said sweat band and said second band at a common point, said third band being of a size convenient to pass through narrow spaces intermediate the frame body and pin of the watch frame to secure said watch to said first band on a first side, and a fourth band attached to said sweat band on a second side of its outer surface and a and fifth band attached to said sweat band and said fourth band at a common point, said fifth band being of a size convenient to pass through narrow spaces intermediate the frame body and pin of a watch to secure said watch to said first band on a second side, and the distance between the common point of attachment of said second and third bands and the common point of attachment of said fourth and fifth bands being approximately the width of a watch frame, quickly releasable fastening means for easily securing said third band to said second band and easily detaching said third band from said second band and for easily securing said fifth band to said fourth band and easily detaching said fifth band from said fourth band, and where said fastening means does not prevent said third band and said fifth band from being passed through narrow spaces intermediate the frame body and pin of a watch, and further where said easily releasable fastening means comprises facing portions of a hook-and-loop closure material.

* * * * *